United States Patent [19]

Gurley

[11] Patent Number: 4,575,170

[45] Date of Patent: Mar. 11, 1986

[54] SOLDERLESS CONNECTOR

[75] Inventor: F. Stevenson Gurley, Tempe, Ariz.

[73] Assignee: Rogers Corporation, Rogers, Conn.

[21] Appl. No.: 688,880

[22] Filed: Jan. 4, 1985

[51] Int. Cl.[4] ..... H01R 11/00

[52] U.S. Cl. ..... 339/59 M; 339/61 R

[58] Field of Search ..... 339/59 R, 59 M, 61 R, 339/61 C, 30, DIG. 1

[56] References Cited

U.S. PATENT DOCUMENTS

| | | | |
|---|---|---|---|
| 3,569,901 | 3/1971 | Connor | 339/30 |
| 4,390,223 | 6/1983 | Zenkich | 339/61 R |
| 4,518,648 | 5/1985 | Miyata et al. | 339/59 M |

*Primary Examiner*—Gil Weidenfeld
*Assistant Examiner*—Paula Austin
*Attorney, Agent, or Firm*—Fishman & Dionne

[57] ABSTRACT

A solderless connector is presented wherein a prestressed elastomeric element is loaded inside a connector housing chamber or cavity so as to effect electrical contact between circuit devices. In essence, the instant invention employs the restoring forces of a stressed elastomeric material to exert forces in a compressive mode. Thus, in attempting to return to its restored (memory) position, a stretched elastomeric element exerts a pressure inside the connector housing channel which forces the terminal portions of the circuit devices into electrical contact.

10 Claims, 5 Drawing Figures

SOLDERLESS CONNECTOR

BACKGROUND OF THE INVENTION

This invention relates to a method and apparatus for interconnecting electrical circuit elements. More particularly, this invention relates to a new and improved solderless connector for establishing and maintaining electrical contact between circuit elements.

A conventional method of interconnecting electrical or electronic circuit components consists of soldering terminals on the components to conductors which deliver current to or from the components. While generally suitable for its intended purposes, interconnecting electrical components via soldering terminals does suffer from certain drawbacks and deficiencies. For example, the substrate which supports an exposed terminal must be able to withstand relatively high temperatures with no adverse effects. Also, soldering connections can be time consuming and therefor be labor intensive and expensive. Another problem with soldered connections is the relative difficulty in disconnecting a soldered terminal during repairs and manufacturing.

In some applications it has been found desirable to replace soldering as a technique for use in establishing connections to flexible and other circuits. In these applications, the requisite electrical contact may be established by mechanically pressing the terminal portions of the circuit against terminal pads on the connector, device or another circuit. Such prior art pressure connections are customarily made with the the aid of a solid resilient pressure applicator, such as an elastomeric member, which is placed in compression to bias at least one of the components to be electrically interconnected toward the other component to hold the terminal portions thereof in electrical contact. Such a solderless connection system is disclosed in U.S. Pat. No. 4,468,074, assigned to the assignee hereto and incorporated herein by reference.

While pressure connections of the type briefly described above facilitate circuit assembly and repair, and also allow for the use of low cost and low temperature plastics while eliminating the time consuming and thus costly step of soldering, the prior art pressure connectors have certain drawbacks and problems. For example, many pressure type solderless connectors rely on outside forces such as plates clamps or bars to apply pressure to connector pins. These plates, clamps or bars necessitate screws and other types of securing devices which may make assembly of the connector burdensome and time consuming.

SUMMARY OF THE INVENTION

The above-discussed and other problems of the prior art are overcome or alleviated by the solderless connection method and apparatus of the present invention. In accordance with the present invention, a pre-stressed elastomeric element is provided inside a connector housing cavity so as to force the contacts of circuit devices to be connected into electrical connection. This pressure is provided by the restoring forces of the pre-stressed elastomeric material as it tries to return to it original shape, i.e., memory position. Clips or a suitable molded portion of the elastomeric element would act to prevent the rubber strip from completely returning to its original shape.

As the present invention precludes the use of securing means such as screws or clamps, the problems discussed above with regard to such securing means are alleviated. Accordingly, the solderless connector of the present invention provides ease of assembly and thereby lower installation and repair costs.

The above-discussed and other advantages of the present invention will be apparent to and understood by those skilled in the art from the following detailed description and drawings.

BRIEF DESCRIPTION OF THE DRAWINGS

Referring now to the drawings, wherein like elements are numbered alike in the several FIGURES.

DESCRIPTION OF THE PREFERRED EMBODIMENT

Figure 1B:
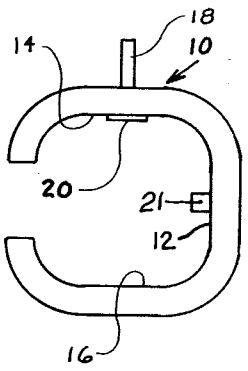
FIG. 1B is a side elevation view of the connector housing of FIG. 1A.
Figure 1A:
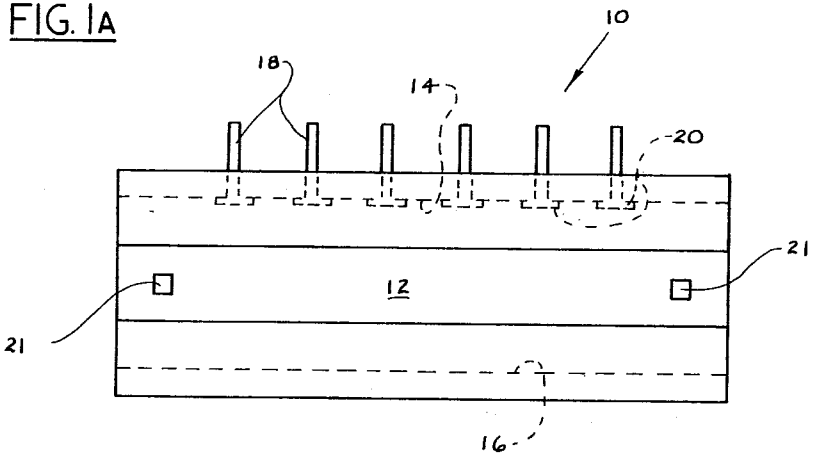
FIG. 1A is a front elevation view of a connector housing suitable for use in accordance with the present invention.

Referring first to FIG. 1A and 1B, a connector housing suitable for use in connection with the present invention is shown generally at 10. Housing 10 has a substantially C-shaped channel or slot 12 having upper and lower bearing surfaces at 14 and 16 respectively. Housing 10 includes a plurality of terminal pins 18, each having a contact pad 20 thereon. Terminal pins 18 lead from a circuit device (not shown) and are provided to interconnect the circuit device to a flexible circuit element (shown in FIG. 4). In addition, housing 10 includes a pair of locating pins 21 which will mate with corresponding openings or holes in the flexible circuit element to ensure precise position of the flexible circuit with respect to terminal pins 18.

Figure 2:
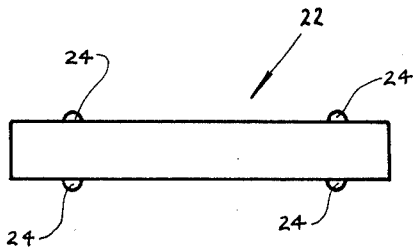
FIG. 2 is an elevation view of an elastomeric element, in a relaxed state, suitable for use in accordance with the present invention.
Figure 3:
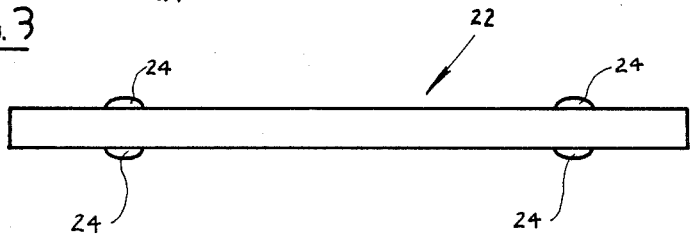
FIG. 3 is an elevation view of the elastomeric element of FIG. 2 in a stretched state.

Referring now to FIGS. 2 and 3, an elastomeric element 22 is shown in restored and stressed states, respectively. Elastomeric element 22 is preferably provided with molded shoulders or stops 24 which act to prevent the element from totally contracting after insertion into connector housing 10. Alternatively, elastomeric element 22 may be securely held in housing 10 by any other suitable means such as pins, clamps, etc. Elastomeric element 22 is preferably comprised of silicone rubber materials. Other suitable elastomers include, but are not limited to, polyurethane rubber, natural rubber, etc.

Figure 4:
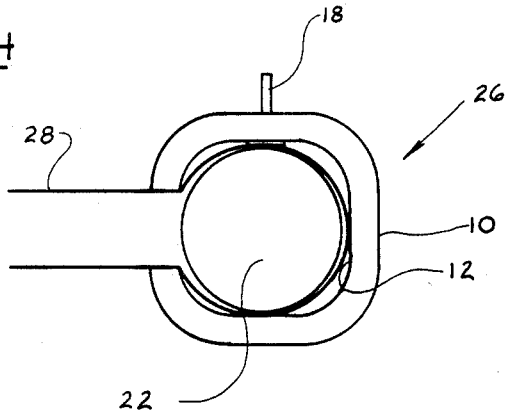
FIG. 4 is a cross-sectional elevation view of a solderless connection in accordance with the present invention.

Turning now to FIG. 4, an assembled solderless connector in accordance with the present invention is shown at 26. Connector 26 includes housing 10 which has been loaded with pre-stressed or stretched elastomeric element 22' from FIG. 3. It will be appreciated that when elastomeric strip 22' is stressed or stretched, the diameter thereof is decreased as comparitively shown in FIGS. 2 and 3. The fully restored element 22' is dimensioned so as to be larger than the channel or slot 12 in housing 10. Upon stretching thereof, elastomeric strip or element 22' decreases in diameter to less than the diameter of channel 12. At that point, stressed element 22' is loaded into the channel and held therein (in a stretched state) by the molded stops 24 or other suitable means. Prior to loading stressed elastomeric element 22', a flexible circuit element 28 comprised of a nonconductive substrate having conductive contacts thereon is provided within connector housing 10. Pin 18 and contact pads 20 are then aligned with preselected conductive contacts on circuit element 28 via the locating pins 21 and corresponding openings on circuit element 28, to effect electrical connection therebetween.

After insertion of the stressed elastomeric element 22' within connector housing 10, flexible circuit element 28 will be firmly urged into electrical contact with the contact pads 20 of pins 18. An important feature of the present invention is that by prohibiting the elastomeric strip 22' from full restoration, restoring force or pressure will always be applied to the connector housing walls through the flexible circuit 28 to the connector terminal pins 18. In effect, the solderless connector of the present invention employs the restoring forces of an elastomeric material, i.e., silicone rubber, to exert forces in a compression mode. Thus, in attempting to return to its restored (memory) position, the stretched elastomeric member 22' exerts a pressure inside the connector housing channel 12 which forces the contacts of flexible circuit element 28 into electrical contact with the contact pads 20 of terminal pins 18. In a preferred embodiment, housing 10 has a C-shape as shown in the FIGURES to preclude flexible circuit element 28 dislodging therefrom.

The solderless connector of the present invention will effect a strong electrical connection and will not necessitate the use of screws, bolts, clamps or other securing devices associated with prior art solderless connectors. Accordingly, the present invention affords ease of assembly which results in lower assembly and repair costs and time.

It will be appreciated that while the solderless connector of the present invention is especially well suited for effecting connection between a flexible circuit element and a rigid circuit device, it may also effect interconnection between a pair of flexible circuit elements which are both disposed within housing 10. It will further be appreciated that the present invention may connect a rigid circuit element with a plurality of flexible circuit elements in addition to flexible/flexible connections and flexible/rigid connections.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A solderless connector for effecting electrical contact between terminal portions of circuit devices, at least one of said devices being a flexible circuit device, comprising:

rigid connector housing means, said housing means including a channel therein, said channel having a selected diameter; and stressed elastomeric element means being loaded in said channel, said element means having a first diameter which is less than said channel diameter in a stressed state and a second diameter which is greater than said channel diameter in a restored state;

said stressed elastomeric element means urging said terminal portions of said circuit devices into electrical contact.

2. The solderless connector of claim 1 wherein said housing is substantially C-shaped.

3. The solderless connector of claim 1 wherein said elastomeric element means is comprised of an elastomer selected from the group consisting of silicone rubber, polyurethane rubber or natural rubber.

4. The solderless connector of claim 1 including:

means for maintaining said elastomeric element in said stressed state after being loaded in said housing means channel.

5. The solderless connector of claim 4 wherein said maintaining means includes:

stops positioned on elastomeric element means which engage said housing means.

6. The solderless connector of claim 5 wherein:

said stops are molded into said elastomeric element means.

7. The solderless connector of claim 1 including:

at least one terminal pin located through said housing, said terminal pin connecting the outside of said housing with said channel.

8. The solderless connector of claim 1 wherein said terminal pin includes:

a contact pad on one end thereof.

9. The solderless connector of claim 1 wherein said housing includes:

means for accurately aligning said flexible circuit device within said channel.

10. The solderless connector of claim 9 wherein said aligning means comprises:

at least one locating pin extending from said channel and adapted to mate with a corresponding opening on said flexible circuit device.

* * * * *